United States Patent [19]

Kingsley

[11] 4,319,310

[45] Mar. 9, 1982

[54] SOLAR SIGNS

[76] Inventor: Vernon T. Kingsley, Camel Sq., Suite 145F, 4350 E. Camelback Rd., Phoenix, Ariz. 85018

[21] Appl. No.: 162,808

[22] Filed: Jun. 25, 1980

[51] Int. Cl.[3] ..... F21L 7/00

[52] U.S. Cl. ..... 362/183; 362/184; 362/252; 362/812

[58] Field of Search ..... 362/183, 184, 252, 812

[56] References Cited

U.S. PATENT DOCUMENTS 3,979,656 9/1976 Takeda ..... 362/183

4,080,221 3/1978 Manelas ..... 362/183

*Primary Examiner*—Stephen J. Lechert, Jr.

*Attorney, Agent, or Firm*—Warren F. B. Lindsley

[57] ABSTRACT

Self-contained solar signs utilizing incident solar energy employing solar cells or thermal absorbers for generating electricity which is stored and later used for energizing sign illuminating lamp or lamps.

4 Claims, 6 Drawing Figures

SOLAR SIGNS

BACKGROUND OF THE INVENTION

In recent years the rapid expansion of the world's population coupled with the accelerated technological development of large sectors of the world has produced a dramatic increase in the demand for energy in all forms including fuels and electricity for heating, lighting, transportation and manufacturing processes. The construction of hydroelectric facilities and the development of fossil fuel resources has continued at a rapid rate, but it becomes increasingly evident for a number of reasons that these efforts are inadequate to keep pace with the demands of the growing population.

In the face of these growing demands and limited resources, there is one source of energy which is readily available to every country in the world in virtually unlimited quantities. This untapped source is solar energy. *The World Book Encyclopedia* (copyright 1963, U.S.) states that the amount of solar energy reaching the earth in one day equals the energy that could be produced by burning 550,000,000,000 tons of coal—as much coal as would be dug in the United States in 1,000 years at the 1963 rate of mining. It further states that enough solar energy reaches the United States in 20 minutes to fill the country's entire power needs for one year.

The interest in this almost boundless resource and in its development and harnessing for use in homes and factories is rising as other resources dwindle. Its desirability is further enhanced by the fact that solar energy may be converted to practical use without the hazard of environmental contamination.

PRIOR ART

Self-luminous solar signs of the type disclosed herein are not known. Other patents such as U.S. Pat. No. 3,379,394 which discloses an optical solar energy converter utilizing one end of a cluster of optical fibers to collect solar energy and to conduct it to a common point for storage as thermal energy and subsequent conversion into solar energy have existed but these systems are expensive to construct and service and have not been accepted commercially.

U.S. Pat. No. 3,376,165 discloses apparatus for converting solar energy to electrical energy but is not embodied in a solar sign.

U.S. Pat. No. Re. 25,242 discloses apparatus employing a plurality of thermo-electric elements arranged to form a hollow cylinder and a lens system to concentrate heat rays of the sun into a beam within the cylinder.

SUMMARY OF THE INVENTION

None of these prior art structures, however, use solar cells, for example, mounted on a display sign for absorption of incident solar rays, convert the rays into electrical energy which is stored to be later used to energize the lighting system which forms the illumination for the display of the sign.

Accordingly, a new and improved solar sign is provided which utilizes solar energy for illumination of the display areas of the sign.

Another object of this invention is to provide an improved converter for collecting incident solar energy from a plurality of surfaces and conducting it to a central concentrator where it is reconverted as light for sign illumination purposes.

A further object of this invention is to provide a display sign which absorbs solar energy during periods of sunlight and uses said stored energy during periods of darkness.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be readily described by reference to the accompanying drawing, in which.

DESCRIPTION OF THE PREFERRED EMBODIMENT

Figure 1:
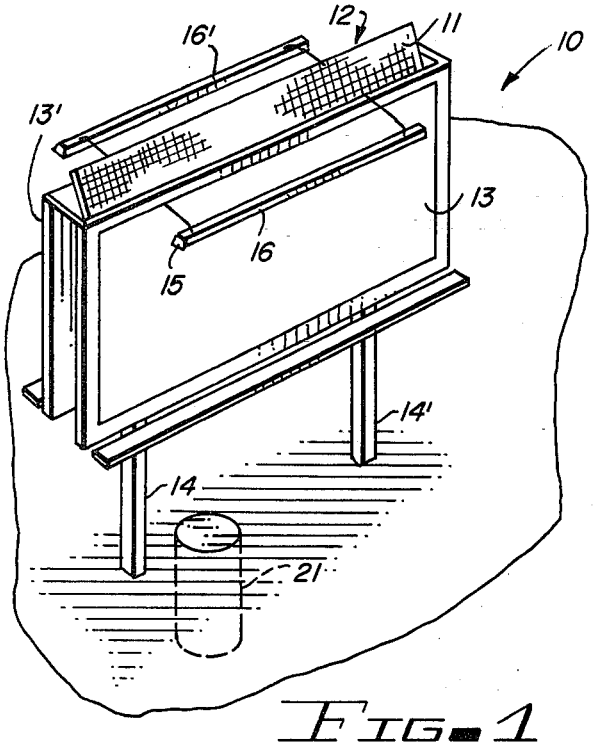
FIG. 1 is a diagrammatic illustration of a solar illuminated sign embodying the invention.

Referring more particularly to the drawing by characters of reference, FIG. 1 discloses a solar energized sign 10 employing a rack of solar cells 11 such as suitable photovoltaic means oriented with their focal axis parallel to incident rays 12 of sunlight. The sign may comprise one or more illuminable sides 13, 13' which contain the advertising media. Although the sign is shown as comprising the sides 13, 13' formed in a U-shaped configuration mounted on a pair of ground supported posts 14, 14', it may form any suitable geometrical configuration either elevated above the ground or supported on its surface and still fall within the scope of this invention.

Each side 13, 13' of the solar sign 10 is illuminated at night by one or more suitable electric lamps 15 mounted in fixtures 16, 16' as shown in FIG. 1.

Figure 2:
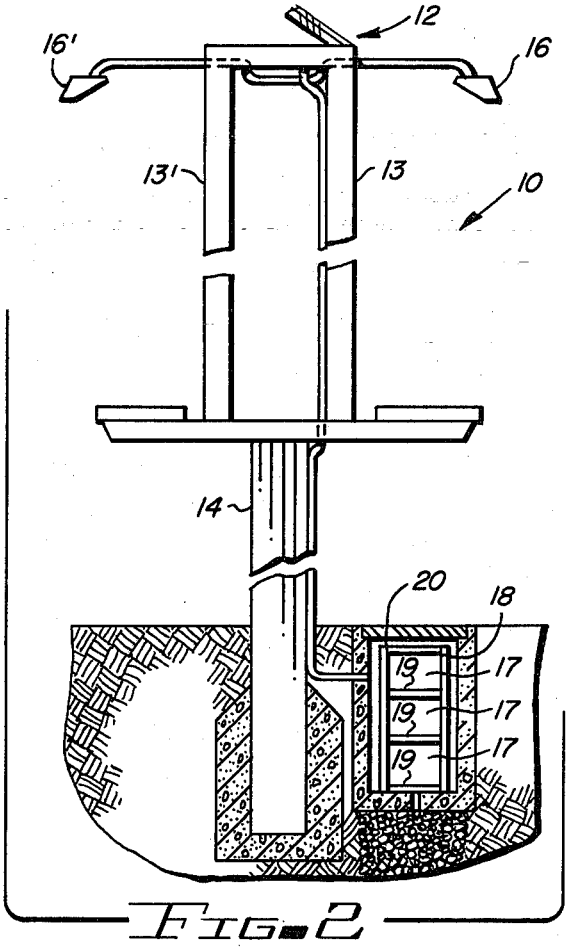
FIG. 2 is a more detailed cross-sectional view of the solar sign illustrated in FIG. 1.
Figure 3:
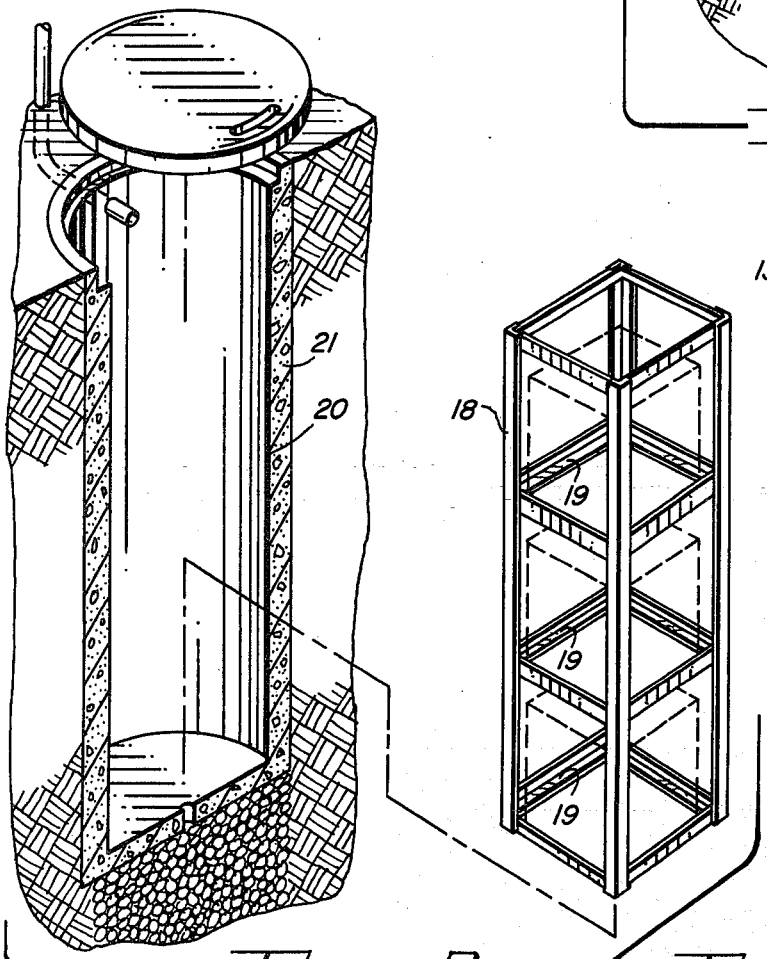
FIG. 3 is an enlarged exploded perspective view of the battery rack and storage container shown in FIGS. 1 and 2.

Each lamp is energized by one or more 12-volt batteries 17 connected in a parallel arrangement as shown in FIGS. 1, 2 and 3 with the batteries mounted on a rack 18 comprises a plurality of vertically arranged shelves 19. This rack may be then housed in a container, such as the cylindrical container 20 which may be buried in a vault 21 in the ground beneath or near the sign 10. As noted the rack may be removed from the vault or placed therein by a suitable hoist.

Figure 4:
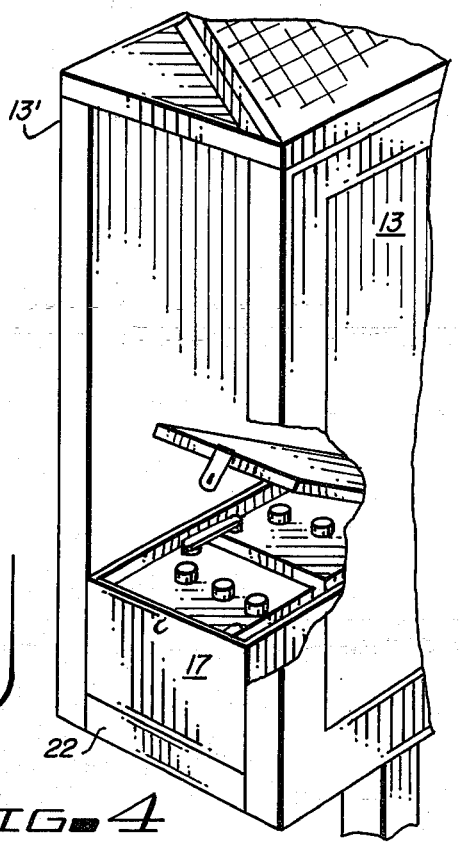
FIG. 4 is a perspective view of a rack for storing the battery in working position between the two faces of the sign.

FIG. 4 illustrates that one or more of the batteries 17 may be mounted on the sign between its sides 13, 13' upon a suitable shelf 22 forming a part of the sign.

Figure 5:
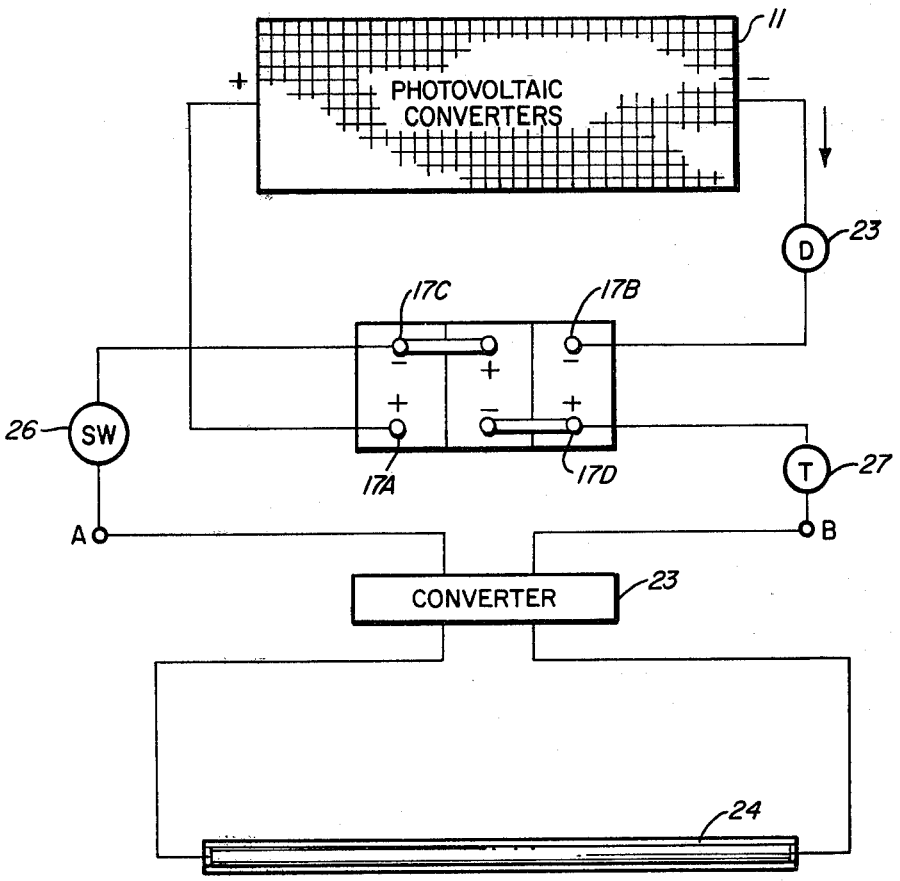
FIG. 5 is a diagrammatic illustration of the solar sign illustrated in FIG. 1.

FIG. 5 discloses a diagrammatic illustration of a wiring diagram for sign 10 wherein rack 11 of suitable solar cells is connected through a diode 23 across the terminals 17A and 17B of a bank of parallelly arranged 12 volt batteries 17. Terminals 17C and 17D of this bank of batteries are connected across a suitable high voltage converter 23 which connects the battery voltage to a suitable high voltage low current power supply necessary to illuminate one or more fluorescent lamps 24 connected in any series or parallel arrangement as well known in the art.

Figure 6:
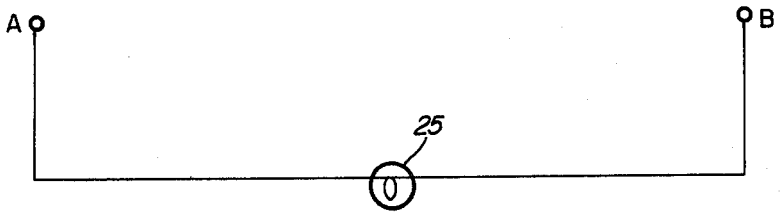
FIG. 6 is a modification of the diagram shown in FIG. 5.

FIG. 6 illustrates that a suitable low voltage incondescent lamp 25 may be directly connected across the bank of batteries 17 through terminals A and B shown in FIG. 5 if so desired for direct current lamp use. A suitable converter for converting the battery voltage to a suitable alternating voltage incandescent lamp use instead of the direct current use shown in FIG. 6 is also intended to be within the scope of this invention.

In order to more effectively implement the use of the solar signs disclosed herein, a switch 26 and timer 27 may be utilized as shown in FIG. 5. With these switching means the sign may be shut off at any time by switch 26 without affecting the charging of the battery or bank of batteries 17. Further, since the sign should be illuminated only during certain hours of a twenty four hour period, timer 27 may be set, as well known in the trade to illuminate the sign only when needed to conserve the energy of battery or batteries 17.

It should also be noted that switch 26 may also be actuated by solar or lack of solar illumination to control illumination of the signs.

Although but a few embodiments of the present invention have been illustrated and described, it will be apparent to those skilled in the art that various changes and modifications may be made therein without departing from the spirit of the invention or from the scope of the appended claims.

What is claimed is:

1. A sign assembly employing incident solar energy for self-illumination thereof comprising in combination:

a display sign, a plurality of photovoltaic solar cells mounted on said sign and exposed to the sun for collecting incident solar energy and converting it into electrical energy, said cells being mounted on a rack extending laterally from the top of said sign, battery means connected to said solar cells for receiving and storing the electrical energy generated by said solar cells, lamp means comprising at least one fluorescent tube mounted on said sign for periodic illumination thereof, timing means connected to said battery means for selective energization of said lamp means from said electrical energy stored in said battery means, and means connected between said battery means and said lamp means for converting the energy of said battery means into high voltage alternating electrical energy sufficient to operate said lamp means.

2. The sign assembly set forth in claim 1 wherein:

said battery means comprises more than one 12 volt battery vertically mounted in a rack vertically positioned in a vault buried in the ground adjacent said sign.

3. The sign assembly set forth in claim 1 wherein:

said sign comprises a U-shaped configuration; and said battery means is mounted between the legs of said U-shaped configuration.

4. The sign assembly set forth in claim 1 wherein:

said timing means further comprises a sensor energizable by an absence of sun light.

* * * * *